US010476193B2

(12) United States Patent
Miyamura et al.

(10) Patent No.: US 10,476,193 B2
(45) Date of Patent: Nov. 12, 2019

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Masaaki Tabata, Mie (JP); Yasuo Omori, Mie (JP); Hajime Matsui, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/304,733

(22) PCT Filed: May 25, 2017

(86) PCT No.: PCT/JP2017/019511
§ 371 (c)(1),
(2) Date: Nov. 27, 2018

(87) PCT Pub. No.: WO2017/217206
PCT Pub. Date: Dec. 21, 2017

(65) Prior Publication Data

US 2019/0305461 A1 Oct. 3, 2019

(30) Foreign Application Priority Data

Jun. 15, 2016 (JP) ..... 2016-118632

(51) Int. Cl.
*H01R 13/42* (2006.01)
*H01R 13/436* (2006.01)

(52) U.S. Cl.
CPC ..... *H01R 13/42* (2013.01); *H01R 13/4362* (2013.01)

(58) Field of Classification Search
CPC ..... H01R 13/4361; H01R 13/4362; H01R 13/42; H01R 13/514
See application file for complete search history.

(56) References Cited

U.S. PATENT DOCUMENTS 5,595,509 A * 1/1997 Fry ..... H01R 13/4362 439/595
5,630,736 A * 5/1997 Yagi ..... H01R 13/4362 439/752

(Continued)

FOREIGN PATENT DOCUMENTS

JP 2004-055470 2/2004
JP 4469534 5/2010
JP 4544065 9/2010

OTHER PUBLICATIONS

International Search Report dated Aug. 15, 2017.

*Primary Examiner* — Briggitte R. Hammond
(74) *Attorney, Agent, or Firm* — Gerald E. Hespos; Michael J. Porco; Matthew T. Hespos

(57) ABSTRACT

It is aimed to detect a mounted state of a second terminal fitting in a terminal unit in which the second terminal fitting is mounted in a terminal holding member. A connector includes an interfering projection (25) formed on a retainer (21). When a second terminal fitting (50) of a terminal unit (30) is properly mounted in a terminal holding member (31), the retainer (21) is displaceable from a partial locking position to a full locking position without the interfering projection (25) interfering with the second terminal fitting (50). When the second terminal fitting (50) is improperly mounted in the terminal holding member (31), the interfering projection (25) interferes with the second terminal fitting (Continued)

(50), thereby restricting a displacement of the retainer (21) to a full locking position.

5 Claims, 13 Drawing Sheets

(56) References Cited

U.S. PATENT DOCUMENTS

| | | | | |
|---|---|---|---|---|
| 5,820,421 | A * | 10/1998 | Makino | H01R 13/4362 439/752 |
| 6,935,904 | B2 * | 8/2005 | Ishiyama | H01R 13/432 439/744 |
| 7,108,551 | B2 * | 9/2006 | Nishide | H01R 13/6272 439/595 |
| 7,988,502 | B2 * | 8/2011 | Nagano | H01R 13/424 439/595 |
| 9,923,295 | B2 * | 3/2018 | Fujimura | H01R 13/42 |
| 10,164,371 | B2 * | 12/2018 | Hara | H01R 13/4362 |
| 2002/0173198 | A1 | 11/2002 | Plate | |
| 2015/0340793 | A1 * | 11/2015 | Kutsuna | H01R 13/4362 439/733.1 |
| 2018/0261946 | A1 * | 9/2018 | Hori | H01R 13/4362 |

* cited by examiner

CONNECTOR

BACKGROUND

Field of the Invention

The invention relates to a connector.

Related Art

Japanese Unexamined Patent Publication No. 2004-055470 discloses a connector used in an in-vehicle LAN (Local Area Network). A wiring harness for in-vehicle LAN is configured by bundling communication wires constituting a twisted pair cable as a noise countermeasure and a power supply wire for supplying power to a device, such as a car navigation system. Terminal fittings fixed to end parts of these wires are inserted into terminal accommodation chambers in a housing. The inserted terminal fittings are held and locked by a retainer mounted into the housing.

The retainer is left at a partial locking position with respect to the housing before the terminal fittings are inserted into the housing. The retainer at the partial locking position does not interfere with the terminal fittings in an inserting process. The retainer is pushed into the housing from the partial locking position to the full locking position after all of the terminal fittings have been inserted into the housing. The retainer at the full locking position retains the terminal fittings.

The terminal fittings connected to two communication wires constituting the twisted pair cable are inserted individually into the terminal accommodation chambers. Thus, end parts of the communication wires are untwisted to ensure an extra length at the time of individual insertion. However, a noise countermeasure function is lost in an untwisted area.

As a measure against this, it is considered to configure a terminal unit by mounting the two terminal fittings connected to the two communication wires into a terminal holding member that has a halved structure and that is separate from the housing. The halved structure enables the terminal fittings to be mounted into the terminal holding member in a direction intersecting a longitudinal direction of the communication wires. Thus, the communication wires need not be untwisted and a reduction of the noise countermeasure function can be avoided.

In this case, the terminal unit can be inserted and mounted into the housing from behind, similar to the terminal fitting connected to the power supply wire. A configuration for locking the retainer mounted in the housing to a groove or a step formed on the terminal holding member is thought as a means for holding the terminal unit in a mounted state.

In a connector using such a terminal unit, the retainer interferes with a part of the terminal unit different from the groove or the step if the terminal unit is inserted incompletely into the housing. Thus, incomplete insertion of the terminal unit can be detected. However, it is not possible to detect whether or not the terminal fittings accommodated in the terminal unit are mounted properly in the terminal holding member.

The invention was completed on the basis of the above situation and aims to detect a mounted state of a terminal fitting in a terminal unit having the terminal fitting mounted in a terminal holding member.

SUMMARY

The invention is directed to a connector with a housing formed with a terminal accommodation chamber. A first terminal fitting is to be inserted into the terminal accommodation chamber. A unit accommodating portion is formed in the housing and can receive a terminal unit configured by mounting the second terminal fitting into a terminal holding member. A retainer is selectively mountable at a partial locking position and a full locking position with respect to the housing. The retainer is configured to allow the insertion of the first terminal fitting into the terminal accommodation chamber at the partial locking position and to retain the first terminal fitting inserted in the terminal accommodation chamber at the full locking position. An interfering projection is formed on the retainer. The retainer is displaceable from the partial locking position to the full locking position without the interfering projection interfering with the second terminal fitting when the second terminal fitting is mounted properly in the terminal holding member. However, a displacement of the retainer to the full locking position is restricted by the interference of the interfering projection with the second terminal fitting when the second terminal fitting is mounted improperly in the terminal holding member.

A mounted state of the second terminal fitting in the terminal holding member can be detected based on whether or not the retainer can be displaced to the full locking position. The retainer as a detection means for the mounted state of the second terminal fitting also functions to retain the first terminal fitting. Thus, the number of components can be reduced.

The interfering projection may be locked to the terminal holding member for temporarily holding the terminal unit in the unit accommodating portion when the retainer is at the partial locking position. According to this configuration, the terminal unit can be held temporarily in the unit accommodating portion by the retainer even without providing a dedicated temporary holding means.

A wire connected to the second terminal fitting may drawn out rearwardly of the terminal holding member. The interfering projection may be disposed to lock the second terminal fitting from behind with the retainer displaced to the full locking position, and the terminal holding member may be formed with a receiving portion to be locked to the interfering projection from behind. According to this configuration, if the wire is pulled rearward, the second terminal fitting presses the interfering projection rearward. However, a pressing force acting on the interfering projection is received by the receiving portion. Thus, there is no possibility that the interfering projection is deformed improperly.

A locking recess may be formed inside the receiving portion and may be open in an outer surface of the terminal holding member. Additionally, the retainer may be formed with a locking projection capable of restricting the detachment of the terminal unit from the unit accommodating portion by being locked to the locking recess. According to this configuration, the inside of the receiving portion functions as a locking means to the retainer. Thus, the shape of the terminal holding member can be simplified.

DETAILED DESCRIPTION

One specific embodiment of the invention is described with reference to FIGS. 1 to 13. Note that, in the following description, a left side in FIGS. 3 to 6 and 11 is defined as a front concerning a front-rear direction. Upper and lower sides shown in FIGS. 1 to 8, 10, 12 and 13 are defined as upper and lower sides concerning a vertical direction.

A connector of this embodiment includes a housing 10 made of synthetic resin, female first terminal fittings 19, a retainer 21 made of synthetic resin and one terminal unit 30.

Figure 1:
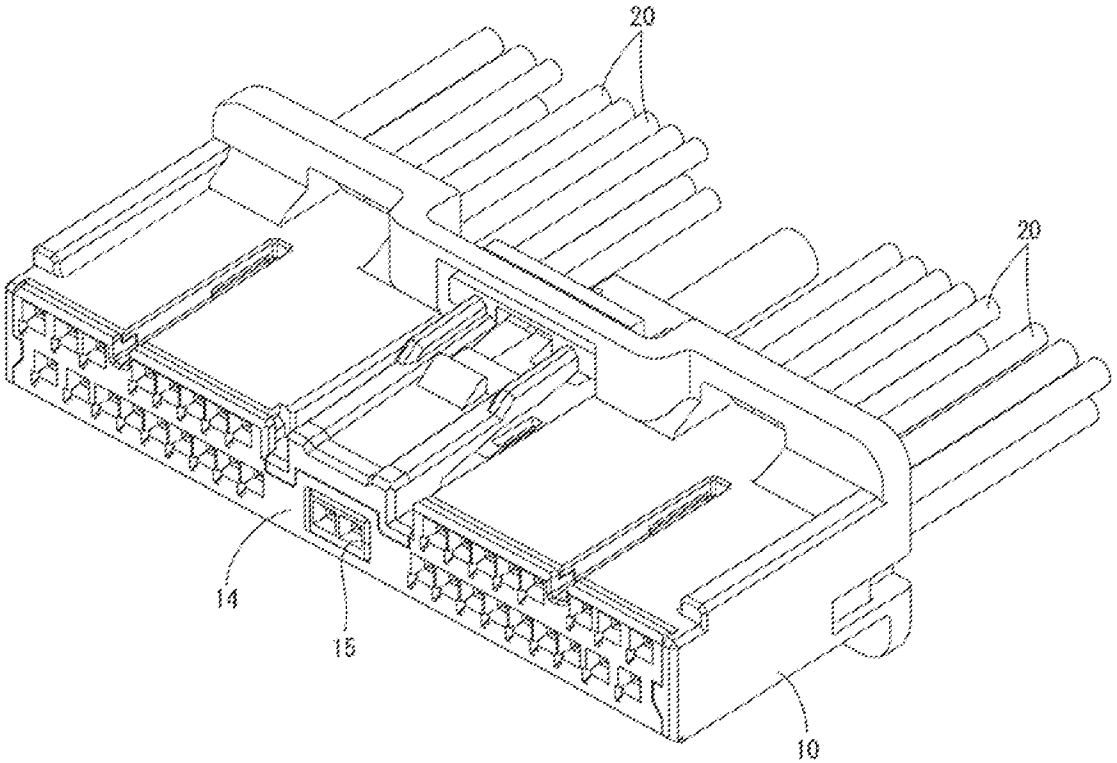
FIG. 1 is a perspective view of a connector of one embodiment.
Figure 2:
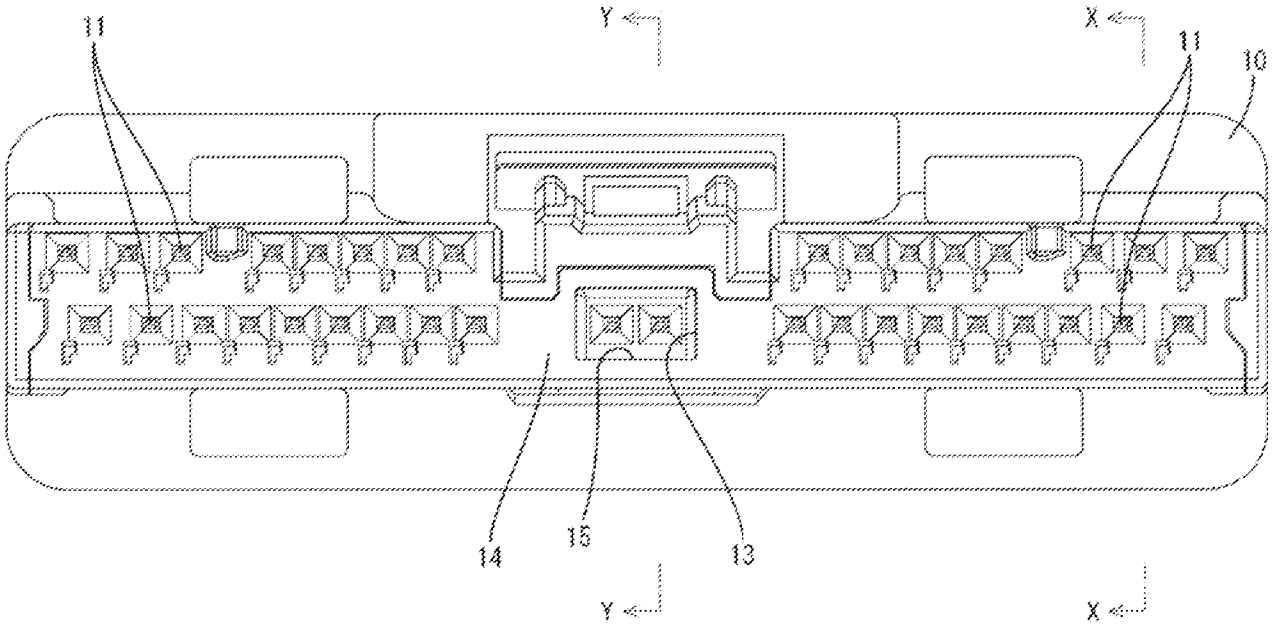
FIG. 2 is a front view of the connector showing a state where a retainer is mounted at a full locking position.
Figure 3:
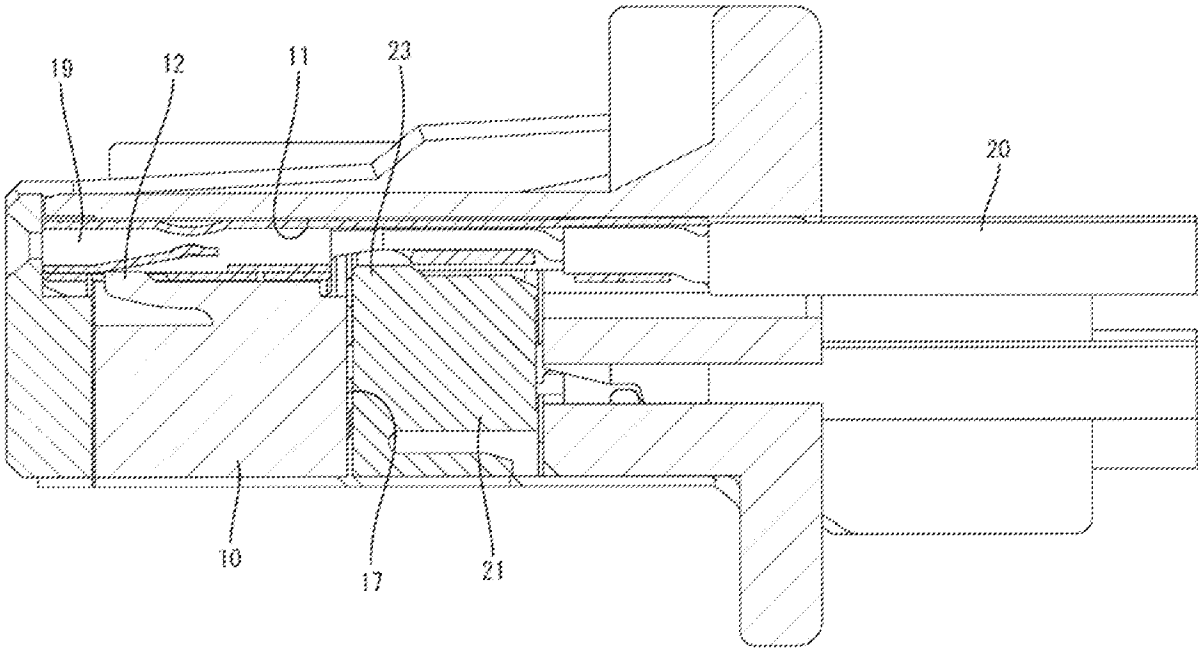
FIG. 3 is a section along X-X of FIG. 2.
Figure 4:
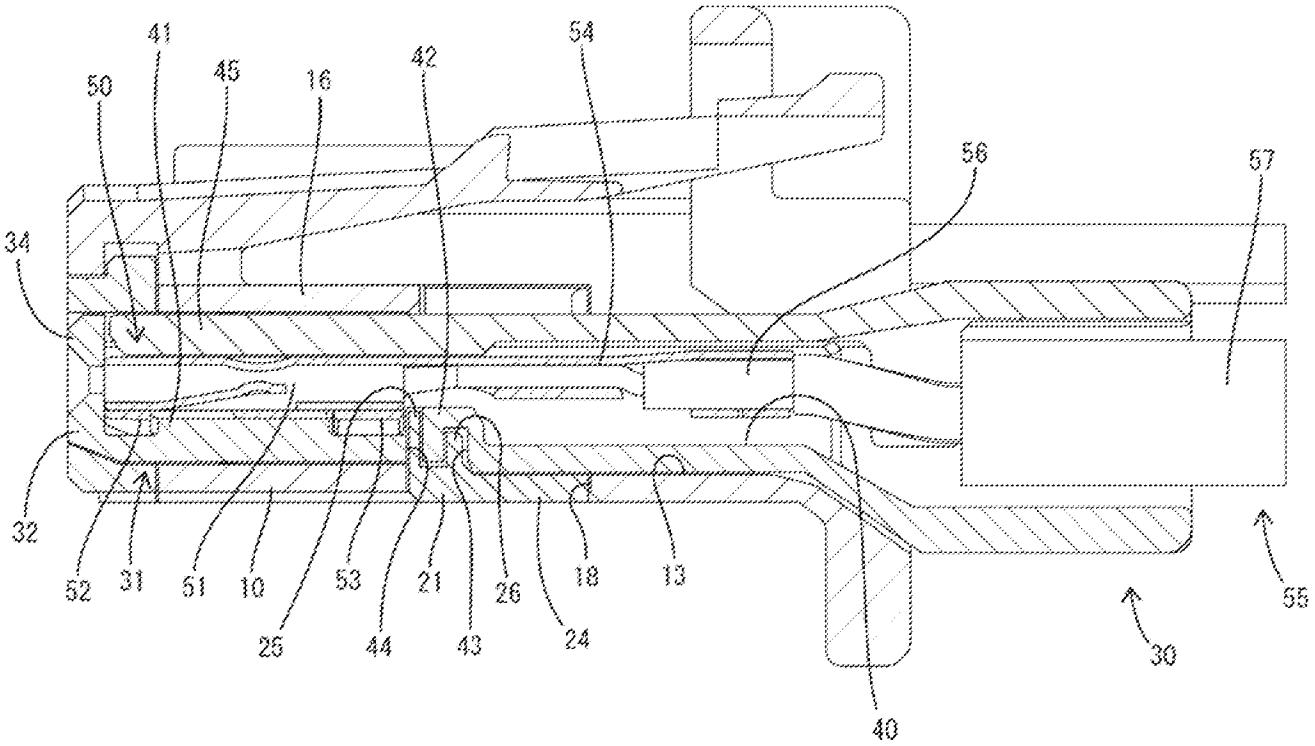
FIG. 4 is a section along X-X of FIG. 2.
Figure 5:
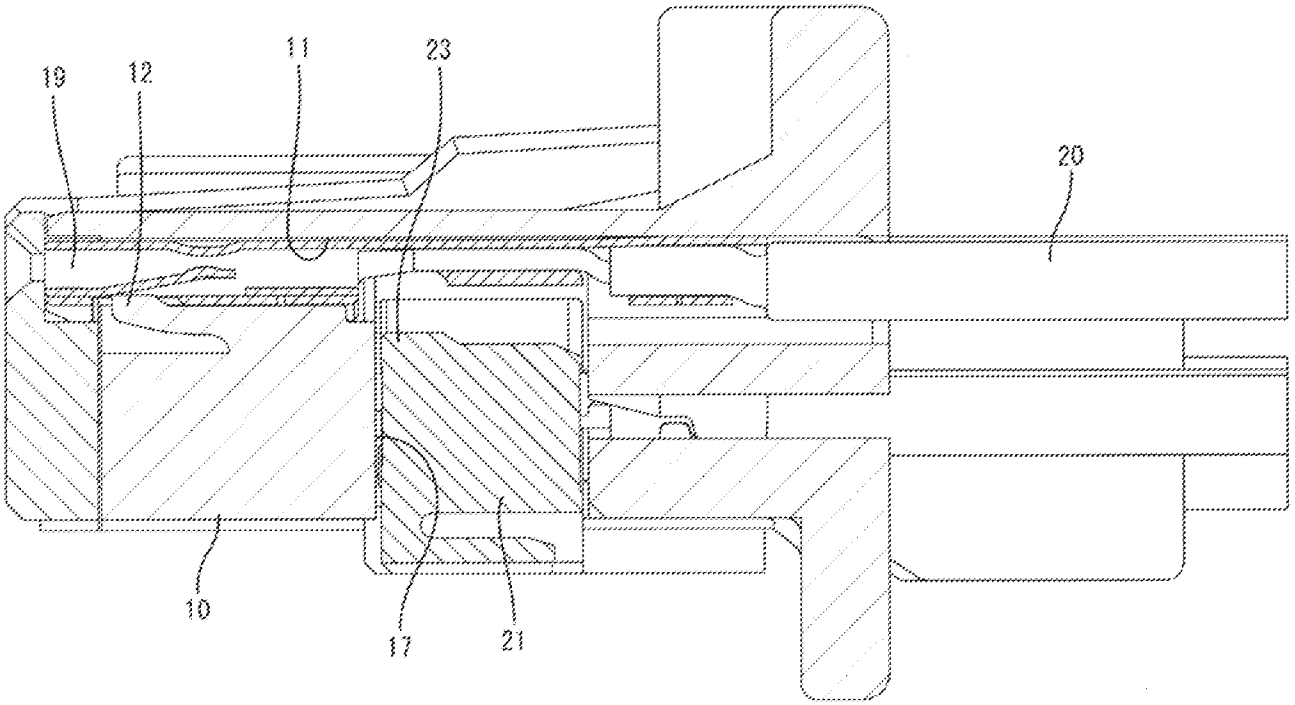
FIG. 5 is a section along X-X showing a state where the retainer is mounted at a partial locking position.

The housing 10 has a flat shape having a lateral dimension (width) larger than a vertical dimension. Terminal accommodation chambers 11 are formed inside the housing 10, and the first terminal fittings 19 are inserted into the respective terminal accommodation chambers 11 from behind the housing 10. As shown in FIGS. 3 and 5, each inserted first terminal fitting 19 is locked and retained by a locking lance 12 formed in the terminal accommodation chamber 11. Each first terminal fitting 19 is connected to a first wire 20 having no noise countermeasure taken therefor.

A unit accommodating portion 13 is formed in a widthwise central part of the housing 10. The unit accommodating portion 13 is long and narrow in the front-rear direction, and a rear end part thereof is open in the rear end surface of the housing 10 as an insertion opening through which the terminal unit 30 is inserted. A front wall 14 of the housing 10 is formed on a front of the unit accommodating portion 13. A fitting opening 15 is open in a widthwise central part of the front wall 14 and communicates with the inside of the unit accommodating portion 13 from the front end surface of the housing 10. A front end area of the upper surface of the unit accommodating portion 13 is covered by a partition wall 16 constituting the upper surface of the housing 10. A rear end area of the upper surface of the unit accommodating portion 13 is open upward over the entire width.

A mounting space 17 is open in the lower surface of the housing 10. The mounting space 17 communicates with all of the terminal accommodation chambers 11 and the unit accommodating portion 13. The mounting space 17 is disposed substantially at a center of the housing 10 in the front-rear direction. A communicating portion 18 of the mounting space 17 penetrates through a lower wall portion of the unit accommodating portion 13. The retainer 21 is mounted into the mounting space 17 from below the housing 10.

Figure 8:
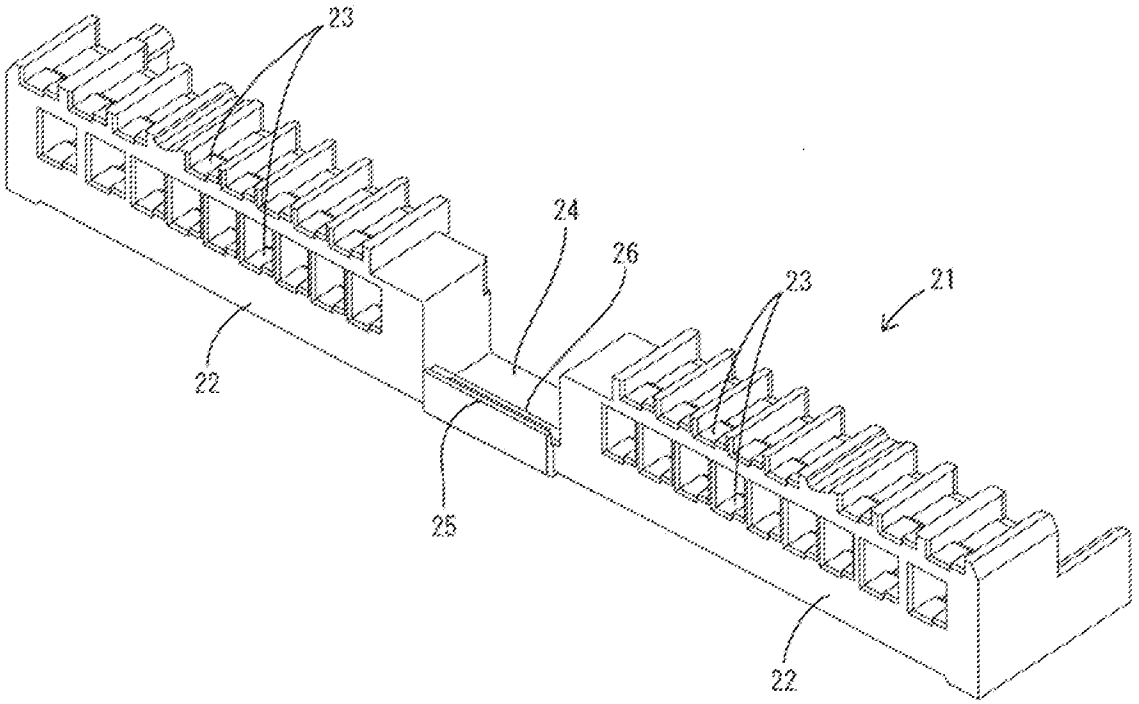
FIG. 8 is a perspective view of the retainer.
Figure 9:
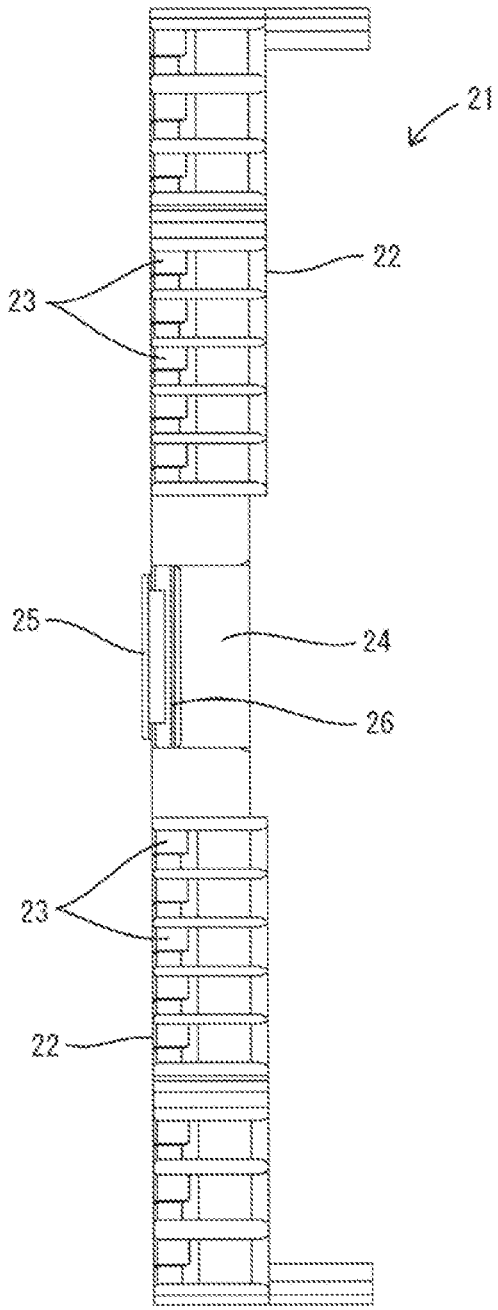
FIG. 9 is a plan view of the retainer.

As shown in FIGS. 8 and 9, the retainer 21 is long and narrow in the lateral direction. The retainer 21 is a single component including left and right retaining function portions 22 and a horizontal coupling plate 24 coupling lowers of the left and right retaining function portions 22. The retainer function portion 22 is formed with retaining projections 23 capable of retaining the first terminal fittings 19 by locking the first terminal fittings 19 inserted into the terminal accommodation chambers 11.

A plate thickness direction of the coupling plate 24 is aligned vertically. An interfering rib 25 projects on a front part of the upper surface of the coupling plate 24 and extends laterally. A locking rib 26 extends laterally along the upper surface of the coupling plate 24 at a position slightly behind the interfering rib 25. A projecting dimension of the interfering rib 25 from the upper surface of the coupling plate 24 is larger than that of the locking plate 26.

The retainer 21 is mounted into the housing 10 from below. The mounted retainer 21 is selectively mounted at a full locking position (see FIGS. 3 and 4) and a partial locking position (see FIGS. 5 and 6) slightly lower than the full locking position with respect to the housing 10. With the retainer 21 held at the full locking position, the entire retaining function portions 22 are accommodated in the mounting space 17 and the retaining projections 23 are disposed at positions for retaining the first terminal fittings 19. Likewise, with the retainer 21 held at the full locking position, the coupling plate 24 is accommodated in the communicating portion 18 and the interfering projection 25 and the locking projection 26 are located to enter the unit accommodating portion 13.

With the retainer 21 held at the partial locking position, substantially the entire retaining function portions 22 excluding lower end parts are accommodated in the mounting space 17 and the retaining projections 23 are retracted to positions where the first terminal fittings 19 are not retained (i.e. positions where the insertion and withdrawal of the first terminal fittings 19 into and from the terminal accommodation chambers 11 are allowed). Likewise, with the retainer 21 held at the partial locking position, the coupling plate 24 projects downward to the outside of the communicating portion 18 and the locking projection 26 is located in the communicating portion 18. Further, a lower end part (base end part) of the interfering projection 25 is located in the communicating portion 18 and a projecting end part (upper end part) of the interfering projection 25 is located in the unit accommodating portion 13.

Figure 10:
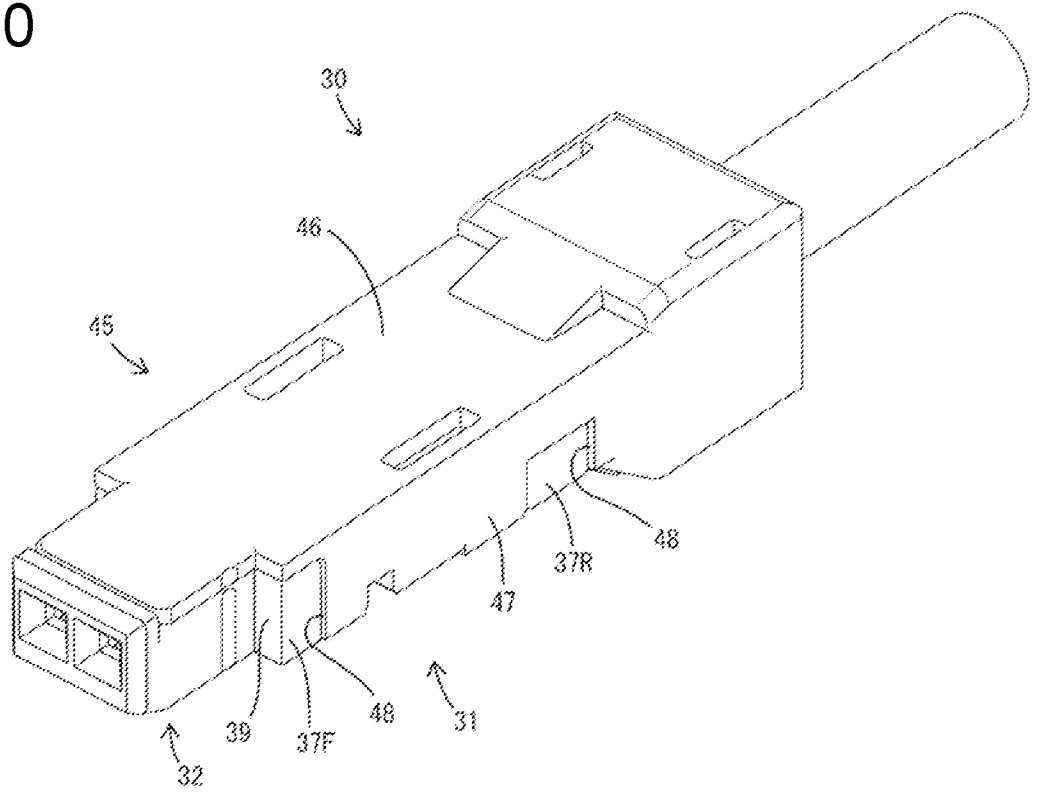
FIG. 10 is a perspective view of a terminal unit.
Figure 11:
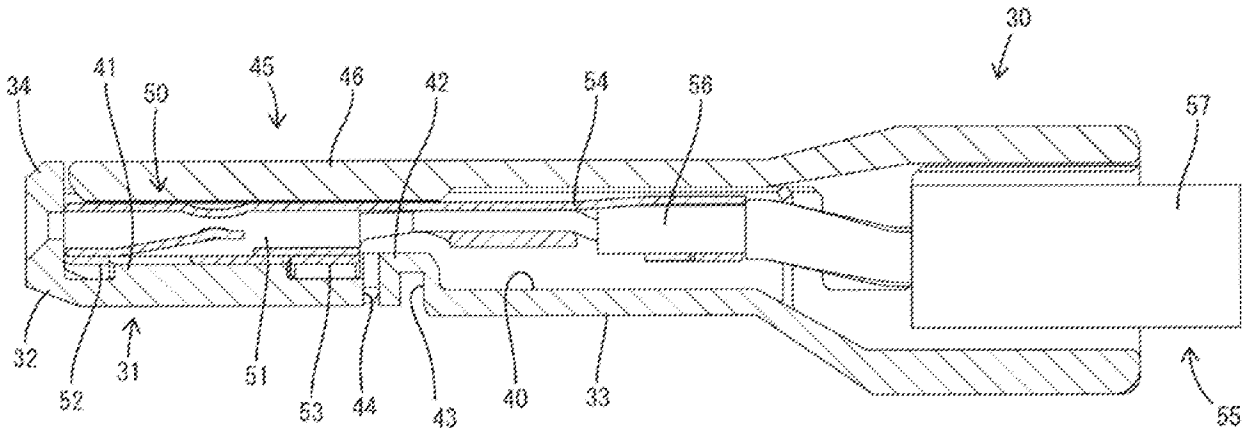
FIG. 11 is a side view in section of the terminal unit.

The terminal unit 30 includes a terminal holding member 31 made of synthetic resin and two second terminal fittings 50 and connected to a front end part of a twisted pair cable 55. As shown in FIGS. 10 and 11, the terminal unit 30 is long and narrow in the front-rear direction as a whole and inserted into the unit accommodating portion 13 from behind the housing 10. The terminal holding member 31 is configured by vertically uniting and assembling a lower case 32 and an upper case 45. An assembling direction of the cases 32, 45 is a direction intersecting a longitudinal direction (axial direction) of the twisted pair cable 55.

Figure 12:
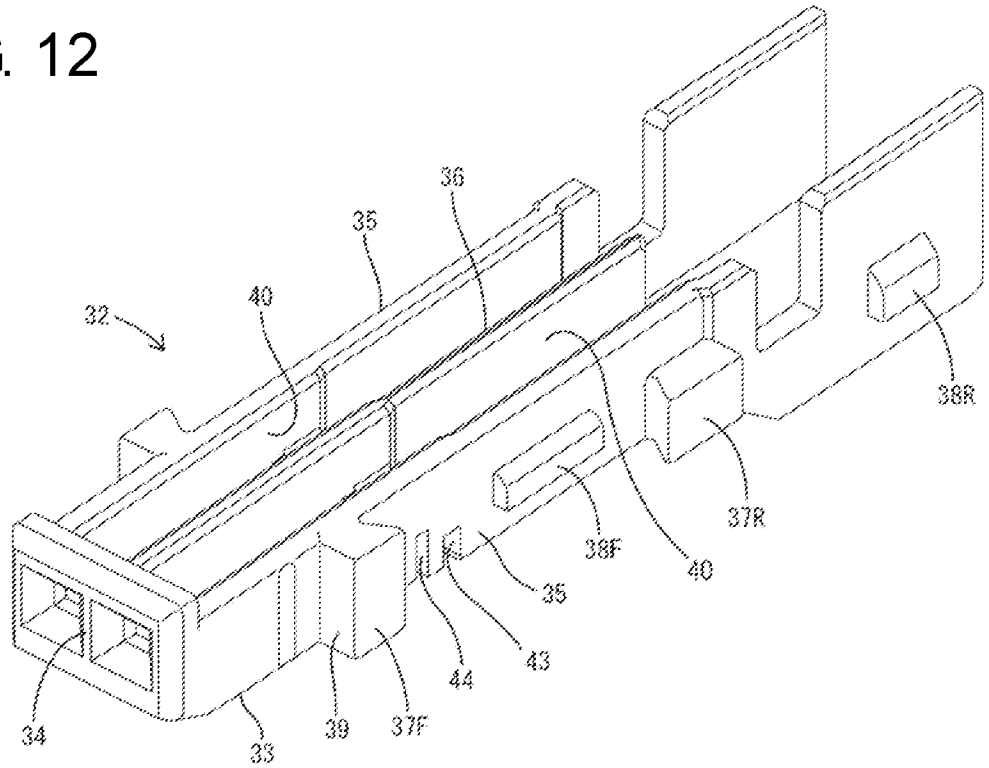
FIG. 12 is a perspective view of a lower case.

As shown in FIG. 12, the lower case 32 includes a bottom wall 33 extending in the front-rear direction, a front wall 34 rising up from the front end of the bottom wall 33, two outer side walls 35 rising up from left and right sides of the bottom wall 33 and an intermediate wall 36 rising up from a widthwise center of the bottom wall 33.

Outer surfaces of the left and right outer side walls 35 have two bilaterally symmetrical positioning projections 37F, 37R spaced apart in the front-rear direction and two bilaterally symmetrical lock projections 38F, 38R spaced apart in the front-rear direction. The front positioning projections 37F are on front end parts of the outer side walls 35, the front lock projections 38F are disposed behind the front positioning projections 37F, the rear positioning projections 37R are disposed behind the front lock projections 38F and the rear lock projections 38R are disposed on rear end parts of the outer side walls 35. The left and right positioning projections 37F on the front side project out from both left and right outer side surfaces of the terminal holding member 31, and the front surfaces of these front positioning projections 37F function as forwardly facing butting portions 39.

The lower case 32 is formed with two bilaterally symmetrical terminal accommodation grooves 40 defined by the bottom wall 33, the left and right outer side walls 35 and the intermediate wall 36. As shown in FIG. 11, retaining portions 41 are formed on a front part of the bottom wall 33 to project into the terminal accommodation grooves 40. Two receiving portions 42 are formed at positions behind the retaining portions 41 on the bottom wall 33 and project into the terminal accommodation grooves 40. Groove-like locking recesses 43 are formed inside the receiving portions 42 and open in the lower surface (outer surface) and both left and right side surfaces of the lower case 32 (bottom wall 33).

A detection groove 44 is formed in the bottom wall 33 adjacent to the front surfaces of the receiving portions 42 and extends in the lateral direction. The detection groove 44 penetrates from the upper surface to the lower surface of the bottom wall 33 and allows communication between the outside of the lower case 32 and the two terminal accommodation grooves 40. Further, the rear surface of the detection groove 44 and the front surfaces of the receiving portions 42 are flush and vertically continuous.

The second terminal fitting 50 is accommodated in each of the terminal accommodation grooves 40. The second terminal fitting 50 is long and narrow in the front-rear direction. A front end area of the second terminal fitting 50 serves as a terminal body 51 in the form of a rectangular tube. A step-like first locking portion 52 faces rearward on the lower surface of a front end part of the terminal holding member 31, and a rear end part of the terminal holding member 31 serves as a rearward facing second locking portion 53. The second terminal fitting 50 is held with rearward detachment restricted by locking the first locking portion 52 to the retaining portion 41.

Crimping portions 54 in the form of open barrels are formed in rear end parts of the respective second terminal fittings 50 individually are connected to front end parts of second wires 56. These second wires 56 are used as communication wires (signal wires), and constitute the twisted pair cable 55 having a noise reduction function by being spirally twisted. In an area of the twisted pair cable 55 excluding a front end part, the two second wires 56 are collectively surrounded by a sheath 57. A front end part of the sheath 57 is also accommodated in rear end parts of the terminal accommodation grooves 40.

The second terminal fitting 50 is mounted into the terminal accommodation groove 40 from above the lower case 32. A mounting direction of the second terminal fitting 50 is a direction intersecting the longitudinal direction of the twisted pair cable 55. Thus, the second wires 56 need to be exposed only by a length necessary to crimp the crimping portions 54 of the second terminal fittings 50 and the second wires 56 by a crimping machine (applicator) by removing the sheath 57 in the front end part of the twisted pair cable 55.

Figure 13:
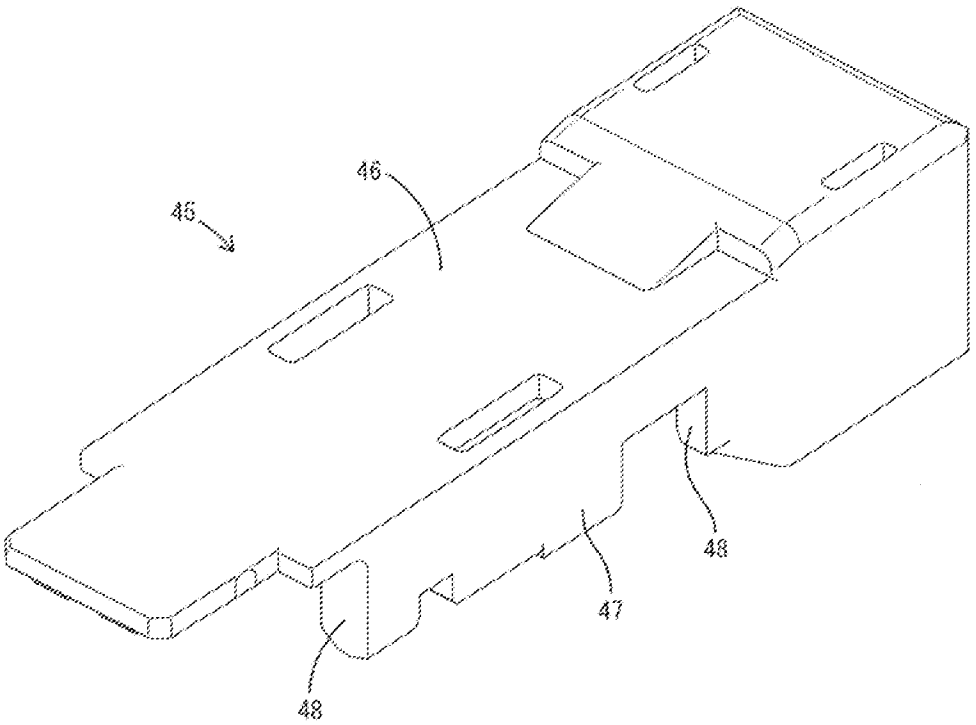
FIG. 13 is a perspective view of an upper case.

As shown in FIG. 13, the upper case 45 includes an upper wall 46 and two side walls 47 extending down from both left and right sides of the upper wall 46. Two locks (not shown) to be locked to the lock projections 38F, 38R of the lower case 32 are arranged on the inner side surfaces of each of the left and right side walls 47 while being spaced apart in the front-rear direction. Similarly, two bilaterally symmetrical positioning portions 48 to be fit to the positioning projections 37F, 37R of the lower case 32 are arranged on each of the left and right side walls 47 while being spaced apart in the front-rear direction.

With the upper case 45 united and assembled with the lower case 32 having the second terminal fittings 50 accommodated therein, the lock projections 38F, 38R of the lower case 32 and the locks of the upper case 45 are locked to lock the cases 32, 45 in an assembled state. Upper surface openings of the terminal accommodation grooves 40 are closed by the upper wall 46 with the cases 32, 45 assembled. Thus, the second terminal fittings 50 do not come out of the terminal accommodation grooves 40.

Next, an assembling procedure of the connector is described. First, the terminal unit 30 is inserted into the unit accommodating portion 13 from behind the housing 10. When the terminal unit 30 reaches a proper position, a front end part of the terminal unit 30 is fit into the fitting opening 15 and, simultaneously, the butting portions 39 contact the front wall 14. Thus, any further insertion of the terminal unit 30 is restricted and the terminal unit 30 is positioned at a proper mount position. When the terminal unit 30 is inserted properly into the unit accommodating portion 13, the locking recesses 43 and the detection groove 44 communicate with outside below the outer surface of the housing 10 via the mounting space 17.

Figure 6:
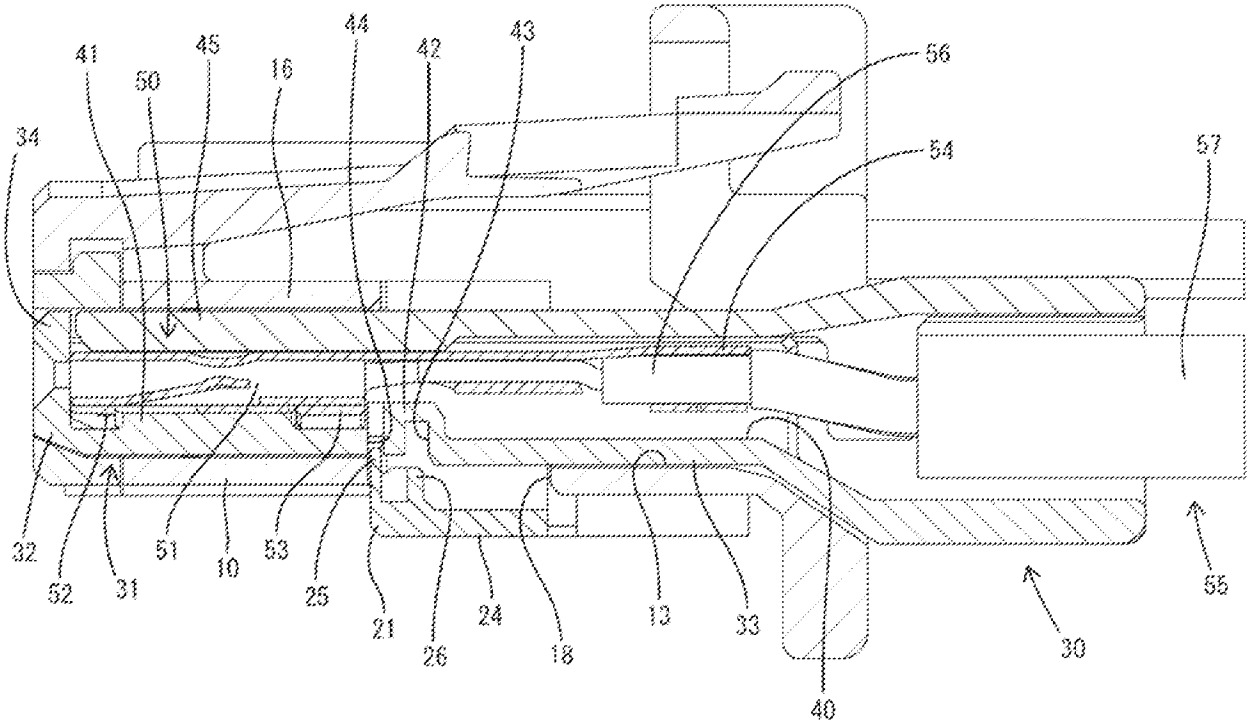
FIG. 6 is a section along Y-Y showing the state where the retainer is mounted at the partial locking position.
Figure 7:
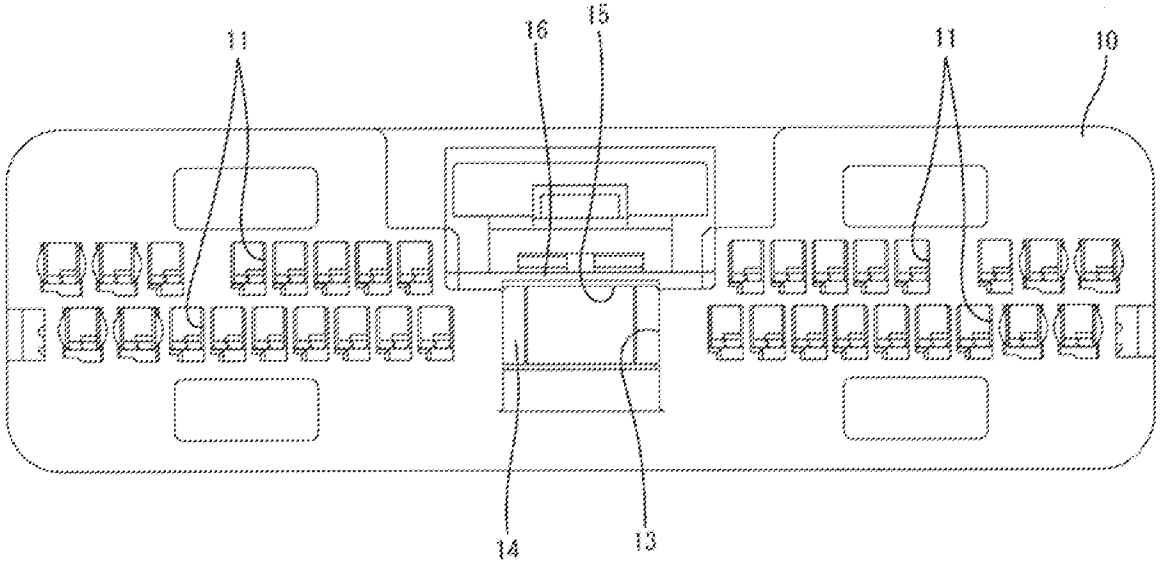
FIG. 7 is a back view of a housing.

After the terminal unit 30 is accommodated into the unit accommodating portion 13, the retainer 21 is assembled with the housing 10 and held at the partial locking position, as shown in FIGS. 5 and 6. In this state, the locking projection 26 is not locked to the locking recesses 43 and is retracted down outside the locking recesses 43. Further, with the retainer 21 mounted at the partial locking position, the upper part of the interfering projection 25 is fit lightly in the detection groove 44. This locking of the interfering projection 25 and the detection groove 44 temporarily holds the terminal unit 30 in the unit accommodating portion 13 with rearward detachment restricted.

The second terminal fitting 50 may not be mounted at the proper position in the terminal holding member 31, such as when the first locking portion 52 rides on the retaining portion 41 and the second locking portion 53 is located to close the detection groove 44. In this situation, the upper end part of the interfering projection 25 interfere with the second locking portion 53 in the process of mounting the retainer 21 into the housing 10. Thus, the retainer 21 cannot be mounted at the partial locking position.

Further, the terminal unit 30 may not be inserted to the proper position in the unit accommodating portion 13. Thus, the upper part of the interfering projection 25 interferes with the lower surface of the terminal unit 30 (terminal holding member 31) without being fit into the detection groove 44. Also in this case, the retainer 21 cannot be mounted at the partial locking position. Thus, a mounted state of the terminal unit 30 in the unit accommodating portion 13 can be detected based on whether or not the retainer 21 can be mounted at the partial locking position.

After the retainer 21 is mounted at the partial locking position, the first terminal fitting 19 is inserted into each terminal accommodation chamber 11 from behind the housing 10 and primarily locked and retained by the locking lance 12 formed in the terminal accommodation chamber 11. After the insertion of all the first terminal fittings 19 is completed, the retainer 21 at the partial locking position is pushed up to the full locking position. When the retainer 21 moves to the full locking position, the retaining projections 23 are locked to the first terminal fittings 19 and reliably retain the first terminal fittings 19. Further, the base end part (lower end part) of the interfering projection 25 is locked into the detection groove 44 and the locking projection 26 is fit and locked into the locking recesses 43 for reliably retaining the terminal unit 30.

If all the first terminal fittings 19 are inserted properly, the retainer 21 can be moved to the full locking position. However, if there is any incompletely inserted first terminal fitting 19, the retaining projection 23 interferes with the incompletely inserted first terminal fitting 19. Thus, the retainer 21 cannot be displaced to the full locking position. Therefore, an inserted state of the first terminal fittings 19 can be detected based on whether or not the retainer 21 can be moved to the full locking position.

The connector of this embodiment includes the housing 10 formed with the terminal accommodation chambers 11, the first terminal fittings 19 to be inserted into the terminal accommodation chambers 11, the terminal unit 30 and the retainer 21 selectively mountable at the partial locking position and the full locking position with respect to the housing 10. The terminal unit 30 is configured by mounting the second terminal fittings 50 into the terminal holding member 31, and mounted into the unit accommodating portion 13 formed in the housing 10. The retainer 21 allows the insertion of the first terminal fittings 19 into the terminal accommodation chambers 11 at the partial locking position and retains the first terminal fittings 19 inserted in the terminal accommodation chambers 11 at the full locking position.

The retainer 21 is formed with the interfering projection 25. When the second terminal fittings 50 are mounted properly in the terminal holding member 31, the retainer 21 is displaceable from the partial locking position to the full locking position without the interfering projection 25 interfering with the second terminal fittings 50. Further, when the second terminal fitting 50 is mounted improperly in the terminal holding member 31, the interfering projection 25 interferes with the second terminal fitting 50, thereby restricting a displacement of the retainer 21 to the full locking position.

According to this configuration, a mounted state of the second terminal fittings 50 in the terminal holding member 31 can be detected based on whether or not the retainer 21 can be displaced to the full locking position. The retainer 21 functions as a detection means for the mounted state of the second terminal fittings 50 also functions to retain the first terminal fittings 19. Thus, the number of components can be reduced.

Further, with the retainer 21 held at the partial locking position, the terminal unit 30 may be held temporarily in the unit accommodating portion 13 by the locking of the interfering projection 25 to the terminal holding member 31. According to this configuration, the terminal unit 30 can be held temporarily in the unit accommodating portion 13 by the retainer 21 even without providing a dedicated temporarily holding means.

Further, the second wires 56 connected to the second terminal fittings 50 are drawn out rearwardly of the terminal holding member 31 and, with the retainer 21 displaced to the full locking position, the interfering projection 25 is disposed to lock the second locking portions 53 of the second terminal fittings 50 from behind. The terminal holding member 31 is formed with the receiving portions 42 to be locked to the interfering projection 25 from behind. According to this configuration, when the second wires 56 (twisted pair cable 55) are pulled rearward, the second terminal fittings 50 press the interfering projection 25 rearward, but a pressing force acting on the interfering projection 25 is received by the receiving portions 42. Thus, there is no possibility that the interfering projection 25 is deformed improperly.

Further, the locking recesses 43 open in the outer surface of the terminal holding member 31 are formed inside the receiving portions 42, and the retainer 21 is formed with the locking projection 26 capable of restricting the detachment of the terminal unit 30 from the unit accommodating portion 13 by locking the locking recesses 43. According to this configuration, the shape of the terminal holding member 31 can be simplified since the insides of the receiving portions 42 function as a locking means to the retainer 21.

The invention is not limited to the above described and illustrated embodiment. For example, the following embodiments also are included in the scope of the invention.

The terminal unit is held temporarily in the unit accommodating portion by the interfering projection in the above embodiment. However, a dedicated temporarily holding means for temporarily holding the terminal unit in the unit accommodating portion may be provided separately from the interfering projection. This dedicated temporarily holding means may be formed on the retainer or may be formed on a component (housing) other than the retainer.

Although the receiving portions to be locked to the interfering projection from behind are provided in the above embodiment, the terminal holding member may be provided with no receiving portion.

Although the locking recesses are formed inside the receiving portions in the above embodiment, the locking recesses may be formed in parts other than the receiving portions.

Although the retainer is mounted into the housing after the terminal unit is mounted into the unit accommodating portion in the above embodiment, the terminal unit may be mounted into the unit accommodating portion after the retainer is mounted at the partial locking position in the housing.

LIST OF REFERENCE SIGNS

10 . . . housing
11 . . . terminal accommodation chamber
13 . . . unit accommodating portion
19 . . . first terminal fitting
21 . . . retainer
25 . . . interfering projection
26 . . . locking projection
30 . . . terminal unit
31 . . . terminal holding member
42 . . . receiving portion
43 . . . locking recess
50 . . . second terminal fitting
56 . . . second wire (wire)

The invention claimed is:

1. A connector, comprising:

a housing formed with a terminal accommodation chamber and a unit accommodating portion;

a first terminal fitting to be inserted into the terminal accommodation chamber;

a terminal unit configured by mounting a second terminal fitting into a terminal holding member, the terminal unit being mounted into the unit accommodating portion;

a retainer selectively mountable at a partial locking position and a full locking position with respect to the housing, the retainer being configured to allow the insertion of the first terminal fitting into the terminal accommodation chamber at the partial locking position and to retain the first terminal fitting inserted in the terminal accommodation chamber at the full locking position; and an interfering projection formed on the retainer;

wherein:

the retainer is displaceable from the partial locking position to the full locking position without the interfering projection interfering with the second terminal fitting when the second terminal fitting is mounted properly in the terminal holding member; and a displacement of the retainer to the full locking position is restricted by the interference of the interfering projection with the second terminal fitting when the second terminal fitting is mounted improperly in the terminal holding member.

2. The connector of to claim 1, wherein the interfering projection is locked to the terminal holding member to temporarily hold the terminal unit in the unit accommodating portion with the retainer held at the partial locking position.

3. The connector of claim 2, wherein:

a wire connected to the second terminal fitting is drawn out rearwardly of the terminal holding member;

the interfering projection is disposed to lock the second terminal fitting from behind with the retainer displaced to the full locking position; and the terminal holding member is formed with a receiving portion to be locked to the interfering projection from behind.

4. The connector of claim 3, wherein:

a locking recess open in an outer surface of the terminal holding member is formed inside the receiving portion; and the retainer is formed with a locking projection capable of restricting the detachment of the terminal unit from the unit accommodating portion by being locked to the locking recess.

5. The connector of claim 1, wherein:

a wire connected to the second terminal fitting is drawn out rearwardly of the terminal holding member;

the interfering projection is disposed to lock the second terminal fitting from behind with the retainer displaced to the full locking position; and the terminal holding member is formed with a receiving portion to be locked to the interfering projection from behind.

* * * * *